US010738614B2

(12) United States Patent
Rogers, Sr.

(10) Patent No.: US 10,738,614 B2
(45) Date of Patent: Aug. 11, 2020

(54) METHOD AND APPARATUS FOR OPERATING AN ENGINE ON COMPRESSED GAS

(71) Applicant: Leroy K. Rogers, Sr., Punta Gorda, FL (US)

(72) Inventor: Leroy K. Rogers, Sr., Punta Gorda, FL (US)

( * ) Notice: Subject to any disclaimer, the term of this patent is extended or adjusted under 35 U.S.C. 154(b) by 3 days.

(21) Appl. No.: 16/052,547

(22) Filed: Aug. 1, 2018

(65) Prior Publication Data

US 2020/0040730 A1 Feb. 6, 2020

(51) Int. Cl.

| | |
|---|---|
| ***F01B 29/04*** | (2006.01) |
| ***F02B 65/00*** | (2006.01) |
| ***F01L 25/08*** | (2006.01) |
| ***F02B 69/04*** | (2006.01) |
| ***F02B 63/06*** | (2006.01) |
| ***F01B 17/02*** | (2006.01) |

(52) U.S. Cl.

CPC ..... *F01B 29/04* (2013.01); *F01L 25/08* (2013.01); *F02B 65/00* (2013.01); *F01B 17/02* (2013.01); *F02B 63/06* (2013.01); *F02B 69/04* (2013.01)

(58) Field of Classification Search

CPC ..... F01B 29/04; F01B 17/02; F01L 25/08; F02B 65/00; F02B 63/06; F02B 69/04

USPC ..... 60/370, 371, 407; 91/187, 275; 415/143, 415/122.1, 140, 182.1, 199.6

See application file for complete search history.

(56) References Cited

U.S. PATENT DOCUMENTS

| | | | | |
|---|---|---|---|---|
| 3,885,387 A * | 5/1975 | Simington | F01B 17/02 | 60/370 |
| 4,018,050 A * | 4/1977 | Murphy | F01B 1/02 | 60/370 |
| 4,292,804 A * | 10/1981 | Rogers, Sr. | F01B 17/02 | 60/407 |
| 4,693,669 A * | 9/1987 | Rogers, Sr. | F04D 17/025 | 415/122.1 |
| 4,769,988 A * | 9/1988 | Clark, Jr. | F02B 63/06 | 60/370 |
| 5,515,675 A * | 5/1996 | Bindschatel | F02B 69/06 | 60/370 |

* cited by examiner

*Primary Examiner* — Hoang M Nguyen

(74) *Attorney, Agent, or Firm* — Justin Luby

(57) ABSTRACT

The present invention relates to a method and apparatus for operating an engine having a cylinder and a piston reciprocable therein on compressed gas. The apparatus comprises a source of compressed gas connected to a distributor which distributes the compressed gas to the cylinder. A valve is provided to selectively admit compressed gas to the cylinder when the piston is in an approximately top dead center position. Compressed gas is provided by a compressor comprising a axial compressor, a deflector blade which is located downstream of the axial compressor, a radial compressor which is located downstream of the deflector blade and a housing with a which encloses the axial compressor, deflector blade, and radial compressor.

7 Claims, 12 Drawing Sheets

METHOD AND APPARATUS FOR OPERATING AN ENGINE ON COMPRESSED GAS

CROSS-REFERENCE TO RELATED APPLICATIONS

Not Applicable

FIELD OF THE INVENTION

The present invention relates to a method and apparatus for operating an engine using a compressed gas as the motive fluid. More particularly, the present invention relates to an apparatus for adapting a pre-existing internal combustion engine for operation on a compressed gas.

BACKGROUND

Air pollution is one of the most serious problems facing the world today. One of the major contributors to air pollution is ordinary internal combustion engine which are used in most motor vehicles today. Various devices, including many items mandated by legislation, have been proposed in an attempt to limit the pollutants which an internal combustion engine exhausts to the air. However, most of these devices have met with limited success and are often both prohibitively expensive and complex. A clean alternative to the internal combustion engine is needed to power vehicles and other machinery.

A compressed gas, preferably air, would provide an ideal motive fluid for a engine since it would eliminate the usual pollutants exhausted from an internal combustion engine. An apparatus for converting an internal combustion engine for operation on compressed air is disclosed in U.S. Pat. No. 3,885,387 issued May 27, 1975 to Simington. The Simington patent discloses an apparatus including a source of compressed air and a rotating valve actuator which opens and closes a plurality of mechanical poppet valves. The valves deliver compressed air in timed sequence to the cylinders of an engine through adapters located in the spark plug holes. However, the output speed of an engine of this type is limited by the speed of the mechanical valves and the fact that the length of time over which each of the valves remains open cannot be varied as the speed of the engine increases.

Another apparatus for converting an internal combustion engine for operation on steam or compressed air is disclosed in U.S. Pat. No. 4,102,130 issued Jul. 25, 1978 to Stricklin. The Stricklin patent discloses a device which changes the valve timing of a conventional four stroke engine such that the intake and exhaust valves open once for every revolution of the engine instead of once every other revolution of the engine. A reversing valve is provided which delivers live steam or compressed air to the intake valves and is subsequently reversed to allow the exhaust valves to deliver the expanded steam or air to the atmosphere. A reversing valve of this type however does not provide a reliable apparatus for varying the amount of motive fluid injected into the cylinders when it is desired to increase the speed of the engine. Further, a device of the type disclosed in the Stricklin patent requires the use of multiple reversing valves if the cylinders in a multi-cylinder engine were to be fired sequentially.

The present inventor, Rogers, disclosed in U.S. Pat. No. 4,292,804 issued Oct. 10, 1981 a method and apparatus for operating an engine having a cylinder and a piston reciprocable therein on compressed gas. The apparatus comprises a source of compressed gas connected to a distributor which distributes the compressed gas to the cylinder. A valve is provided to selectively admit compressed gas to the cylinder when the piston is in an approximately top dead center position. In one embodiment of the present invention the timing of the opening of the valve is advanced such that the compressed gas is admitted to the cylinder progressively further before the top dead center position of the piston as the speed of the engine increases. The engine however, operated utilizing a centrifugal compressor, that was unable to supply sufficiently high volumes of compressed air for the engine to run reliably.

The present inventor, Rogers, disclosed in U.S. Pat. No. 4,693,669 issued Sep. 15, 1987 a supercharger for delivering compressed air to the engine disclosed in U.S. Pat. No. 4,102,130, comprising a shrouded axial compressor, a radial compressor which is located downstream of the axial compressor and a housing. The housing comprising four sections, including a section defining a highly convergent, frustoconical transition duct which favorably directs the discharge of the axial compressor to the inlet of the radial compressor and a hollow, highly convergent, exhaust cone section immediately downstream of the radial compressor which converges into the exhaust port of the supercharger. An annular flow deflector is provided for directing the discharge of the radial compressor into the exhaust cone. The supercharger was able to supply a greater volume of air to the to the engine however, the disclosed supercharger was unable to supply sufficiently high pressure air for the engine to run reliably.

Therefore, it is an object of the present invention to provide a reliable method and apparatus for operating an engine or converting an engine for operation with a compressed gas.

A further object of the present invention is to provide a method and apparatus which is effective to deliver a constantly increasing amount of compressed gas to an engine as the speed of the engine increases.

A still further object of the present invention is to provide a method and apparatus which will operate an engine using compressed gas at a speed sufficient to drive a conventional automobile at highway speeds.

It is still a further object of the present invention to provide a method and apparatus which is readily adaptable to a standard internal combustion engine to convert the internal combustion engine for operation with a compressed gas.

Another object of the invention is to provide a method and apparatus which utilizes cool expanded gas, exhausted from a compressed gas engine, to operate an air conditioning unit and/or an oil cooler.

These and other objects are realized by a method and apparatus according to the present invention for operating an engine having at least one cylinder and a reciprocating piston therein using compressed gas as a motive fluid. The apparatus includes a source of compressed gas and a distributor connected with the source of the compressed gas for distributing the compressed gas to the at least one cylinder. A valve is provided for admitting the compressed gas to the cylinder when the piston is in approximately a top dead center position within the cylinder. An exhaust is provided for exhausting the expanded gas from the cylinder as the piston returns to approximately the top dead center position.

SUMMARY

In a preferred embodiment of the present invention a device is provided for varying the duration of each engine cycle over which the valve remains open to admit compressed gas to the cylinder dependent upon the speed of the engine. In a further preferred embodiment of the present invention, an apparatus for advancing the timing of the opening of the valve is arranged to admit the compressed gas to the cylinder progressively further before the top dead center position of the piston as the speed of the engine increases.

Further features of the present invention include a valve for controlling the amount of compressed gas admitted to the distributor. Also, a portion of the gas which has been expanded in the cylinder and exhausted through the exhaust valve is delivered to a compressor to be recompressed and returned to the source of compressed gas. A gear train is selectively engagable to drive the compressor at different operating speed depending upon the pressure maintained at the source of compressed air and/or the speed of the engine. Still further, a second portion of the exhaust gas is used to cool a lubricating fluid for the engine or to operate an air conditioning unit.

In a preferred embodiment of the present invention, the valve for admitting compressed gas to the cylinder is electrically actuated. The device for varying the duration of each engine cycle over which the intake valve remains open as the speed of the engine increase comprises a rotating element whose effective length increases as the speed of the engine increases such that a first contact on the rotating element is electrically connected to a second contact for a longer period of each engine cycle. The second contact actuates the valve whereby the valve remains in an open position for a longer period of each engine cycle as the speed of the engine increases.

Features of the present invention include an adaptor plate for supporting the distributor above an intake manifold of a conventional internal combustion engine after a carburetor has been removed to allow air to enter the cylinders of the engine through the intake manifold and conventional intake valves. Another adaptor plate is arranged over an exhaust passageway of the internal combustion engine to reduce the cross-sectional area of the exhaust passageway.

Compressed air for the is supplied by a compress for delivering high volume-high pressure compressed air to the engine. The compressor is comprised of a shrouded axial compressor, a radial compressor which is located downstream of the axial compressor, an insert downstream of the axial compressor, and a housing. The housing comprising four sections, including a section defining a frustoconical transition duct which favorably directs the discharge of the axial compressor to the inlet of the radial compressor and a convergent exhaust cone section immediately downstream of the radial compressor which converges into the exhaust port of the compressor with connection points for the insert to attach to, and at least one opening at the exit of the convergent exhaust cone section with a smaller cross-sectional area than the convergent exhaust cone exit port. An annular flow deflector is provided for directing the discharge of the radial compressor into the exhaust cone.

The insert in the compressor prevents the air compressed by the axial and radial compressors from expanding and de-pressurizing in the exhaust port of the compressor, and the at least one opening at the exit of the convergent exhaust cone section further keeps the compressed air from expanding. The result of the compressor design allows the compressor to produce high pressure air, in excess of 400 psi, at high volumes, in excess of 20 cfm (@400 psi) to supply air to the engine.

DETAILED DESCRIPTION OF THE INVENTION AND PREFERRED EMBODIMENT

Figure 1:
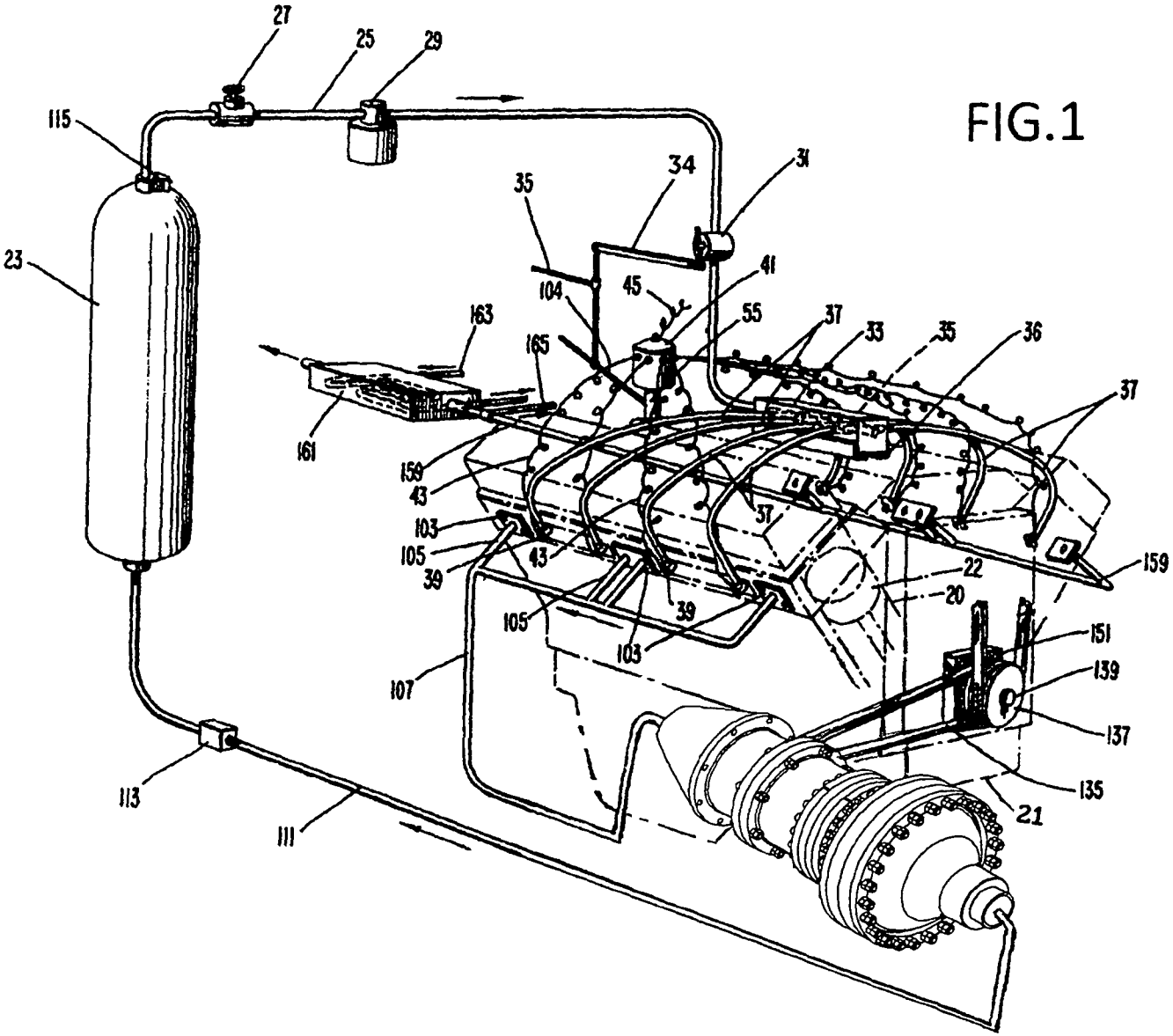
FIG. 1 is a schematic representation of an apparatus according to the present invention arranged on an engine.

With reference to FIG. 1, an engine block 21 (shown in phantom) having two banks of cylinders with each bank including cylinders 20 having pistons 22 reciprocable therein (only one of which is shown in phantom) in a conventional manner. While the illustrated engine is a V-8 engine, it will be apparent that the present invention is applicable to an engine having any number of pistons and cylinders with the V-8 engine being utilized for illustration purposes only. A compressed gas tank 23 is provided to store a compressed gas at high pressure. It may also be desirable to include a small electric or gas compressor to provide compressed gas to supplement the compressed gas held in the tank 23. In a preferred embodiment, the compressed gas is air which can be obtained from any suitable source.

A line 25 transports the gas withdrawn from the tank 23 when a conventional shut off valve 27 is open. In addition, a solenoid valve 29 preferably operated by a suitable key operated switch (not shown) for the engine is also arranged in the line 25. In normal operation, the valve 27 is maintained open at all times with the solenoid valve 29 operating as a selective shut off valve to start and stop the engine 21 of the present invention.

A suitable regulating valve 31 is arranged downstream from the solenoid valve 29 and is connected by a linkage 34 to a throttle linkage 35 which is operator actuated by any suitable apparatus such as a foot pedal (not shown). The line 25 enters an end of a distributor 33 and is connected to an end of a pipe 35 which is closed at the other end. A plurality of holes, which are equal to the number of cylinders in the engine 21, are provided on either side of the pipe 35 along the length of the pipe 35.

When the present invention is used to adapt a conventional internal combustion engine for operation on compressed gas, an adaptor plate 36 is provided to support the distributor 33 in spaced relation from the usual intake opening in the intake manifold of the engine after a conventional carburetor has been removed. In this way, air is permitted to enter the internal combustion engine through the usual passageways and to be admitted to the cylinders through suitable intake valves (not shown). The adaptor plate 36 is secured to the engine block 21 and the distributor 33 by any suitable apparatus, e.g., bolts.

Each of the holes in the pipe 35 is connected in fluid-tight manner to a single line 37. Each line 37 carries the compressed gas to a single cylinder 20. In a preferred embodiment, each of the lines 37 is ½ inch high pressure plastic tubing attached through suitable connectors to the distributor 33 and the pipe 35. Each of the lines 37 is connected to a valve 39 which is secured in an opening provided near the top of each of the cylinders 20. In the case of a conversion of a standard internal combustion engine, the valves 39 can be conveniently screwed into a tapped hole in the cylinder 20 typically provided for a spark plug of the internal combustion engine. In a preferred embodiment, the valves 39 are solenoid actuated valves in order to provide a fast and reliable opening and closing of the valves 39.

Each of the valves 39 is energized by a valve actuator 41 through one of a plurality of wires 43. The valve actuator 41 is driven by a shaft of the engine similar to the drive for a conventional distributor of an internal combustion engine. That is, a shaft 55 of the valve actuator 41 is driven in synchronism with the engine 21 at one half the speed of the engine 21.

A first embodiment of the valve actuator 41 (FIGS. 2 and 3) receives electrical power through a wire 45 which is energized in a suitable manner by a battery, and a coil if necessary (not shown) as is conventional in an internal combustion engine. The wire 45 is attached to a central post 47 by a nut 49. The post 47 is connected to a conducting plate 51 arranged within a housing 53 for the valve actuator 41. Within the housing 53, the shaft 55 has an insulating element 57 secured to an end of the shaft 55 for co-rotation therewith when the shaft 55 is driven by the engine 21. A first end of a flexible contact 59 is continuously biased against the conducting plate 51 to receive electricity from the battery or another suitable source. A second end of the contact 59 is connected to a conducting sleeve 60 which is in constant contact with a spring biased contact 61 which is arranged within the sleeve 60. The contact 61 is biased by a spring 63 which urges the contact 61 towards a side wall of the housing 53.

Figure 3:
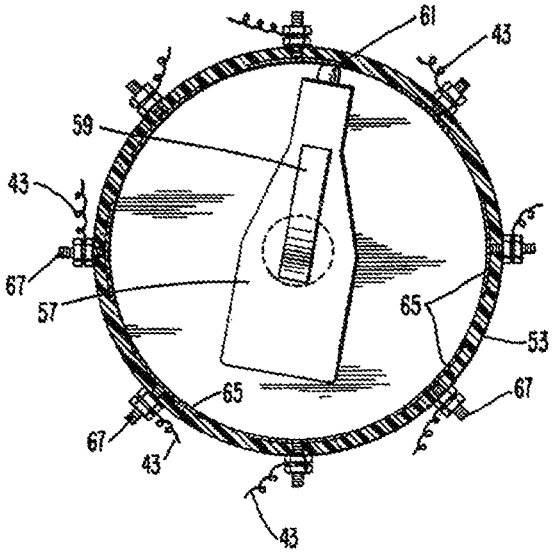
FIG. 3 is a cross-sectional view taken along the line 3-3 in FIG. 2.

With reference to FIG. 3, a plurality of contacts 65 are spaced from one another and are arranged around the periphery of the housing 53 at the same level as the spring biased contact 61. Each contact 65 is electrically connected to a post 67 which extends outside of the housing 53. The number of contacts 65 is equal to the number of cylinders in the engine 21. One of the wires 43, which actuate the valves 39, is secured to each of the posts 67.

In operation, as the shaft 55 rotates in synchronism with the engine 21, the insulating element 57 rotates and electricity is ultimately delivered to successive ones of the contacts 65 and wires 43 through the spring biased contact 61 and the flexible contact 59. In this way, each of the electrical valves 39 is actuated and opened in the proper timed sequence to admit compressed gas to each of the cylinders 20 to drive the pistons 22 therein on a downward stroke.

Figure 2:
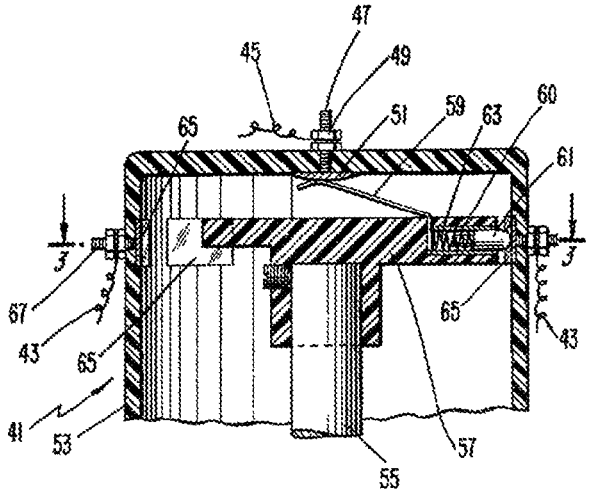
FIG. 2 is a side view of one embodiment of a valve actuator according to the present invention.

The embodiment illustrated in FIGS. 2 and 3 is effective to actuate each of the valves 39 to remain open for a long enough period of time to admit sufficient compressed gas to each of the cylinders 20 of the engine 21 to drive the engine 21. The length of each of the contacts 65 around the periphery of the housing 53 is sufficient to permit the speed of the engine to be increased when desired by the operator by moving the throttle linkage 35 which actuates the linkage 34 to further open the regulating valve 31 to admit more compressed gas from the tank 23 to the distributor 33. However, it has been found that the amount of air admitted by the valves 39 when using the first embodiment of the valve actuator 41 (FIGS. 2 and 3) is substantially more than required to operate the engine 21 at an idling speed. Therefore, it may be desirable to provide a valve actuator 41 which is capable of varying the duration of each engine cycle over which the solenoid valves 39 are actuated, i.e., remain open to admit compressed gas, as the speed of the engine 21 is varied.

A second embodiment of a valve actuator 41 which is capable of varying the duration of each engine cycle over which each of the valves 39 remains open to admit compressed gas to the cylinders 20 dependent upon the speed of the engine 21 will be described with reference to FIGS. 4 and 5 wherein members corresponding to those of FIGS. 2 and 3 bear like reference numerals. The wire 45 from the electrical source is secured to the post 47 by the nut 49. The post 47 has an annular contact ring 69 electrically connected to an end of the post 47 and arranged within the housing 53. The shaft 55 rotates at one half the speed of the engine as in the embodiment of FIGS. 2 and 3.

At an upper end of the shaft 55, a splined section 71 slidably receives an insulating member 73. The splined section 71 of the shaft 55 positively holds the insulating member 73 for co-rotation therewith but permits the insulating member 73 to slide axially along the length of the splined section 71. Near the shaft 55, a conductive sleeve 72 is arranged in a bore 81 in an upper surface of the insulating element 73 generally parallel to the splined section 71. A contact 75, biased towards the annular contact ring 69 by a spring 77, is arranged within the conductive sleeve 72 in contact therewith. The conductive sleeve 72 also contacts a conductor 79 at a base of the bore 81.

The conductor 79 extends to the upper surface of the insulating element 73 near an outer periphery of the insulating element 73 where the conductor 79 is electrically connected to a flexible contact 83. The flexible contact 83 selectively engages a plurality of radial contacts 85 arranged on an upper inside surface of the housing 53. A weak spring 87 arranged around the splined section 71 engages a stop member 89 secured on the shaft 55 and the insulating element 73 to slightly bias the insulating element 73 towards the upper inside surface of the housing 53 to ensure contact between the flexible contact 83 and the upper inside surface of the housing 53. As best seen in FIG. 5, the radial contacts 85 on the upper inside surface of the housing 53 are arranged generally in the form of radial spokes extending from the center of the housing 53 with the number of contacts being equal to the number of cylinders 20 in the engine 21. The number of degrees covered by each of the radial contacts 85 gradually increases as the distance from the center of the upper inside surface of the housing 53 increases.

Figure 4:
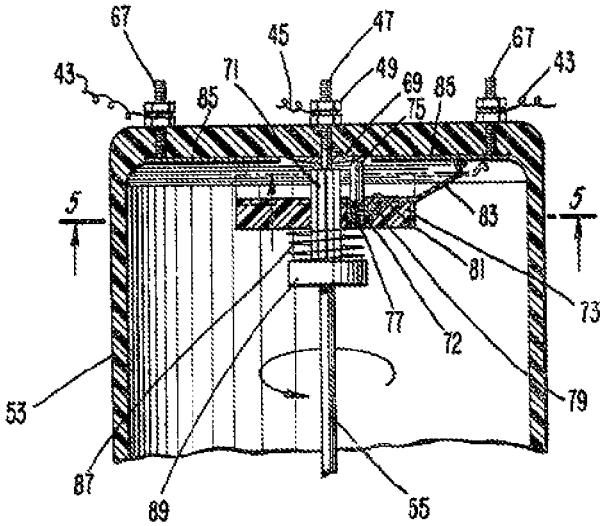
FIG. 4 is a cross-sectional view of a second embodiment of a valve actuator according to the present invention.
Figure 5:
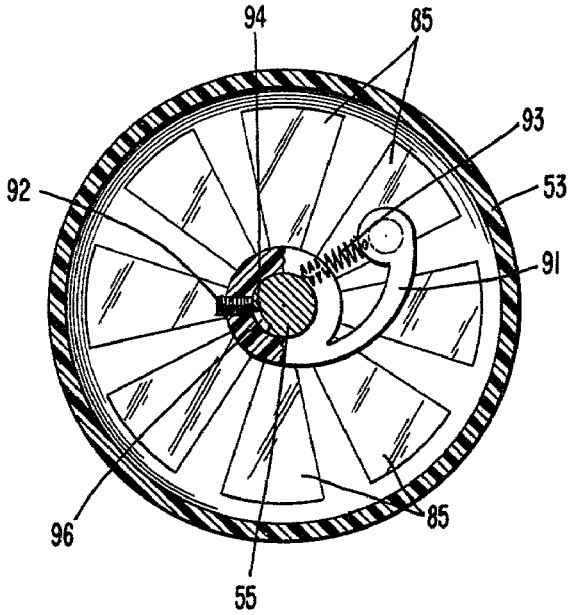
FIG. 5 is a view taken along the line 5-5 in FIG. 4.

In operation of the device of FIGS. 4 and 5, as the shaft 55 rotates, electricity flows along a path through the wire 45 down through post 47 to the annular contact member 69 which is in constant contact with the spring biased contact 75. The electrical current passes through the conductive sleeve 72 to the conductor 79 and then to the flexible contact 83. As the flexible contact 83 rotates along with the insulating member 73 and the shaft 55, the tip of the flexible contact 83 successively engages each of the radial contacts 85 on the upper inside of the housing 53. As the speed of the shaft 55 increases, the insulating member 73 and the flexible contact 83 attached thereto move upwardly along the splined section 71 of the shaft 55 due to the radial component of the splines in the direction of rotation under the influence of centrifugal force. As the insulating member 73 moves upwardly, the flexible contact 83 is bent such that the tip of the contact 83 extends further radially outwardly from the center of the housing 53 (as seen in phantom lines in FIG. 4). In other words, the effective length of the flexible contact 83 increases as the speed of the engine 21 increases.

As the flexible contact 83 is bent and the tip of the contact 83 moves outwardly, the tip remains in contact with each of the radial contacts 85 for a longer period of each engine cycle due to the increased angular width of the radial contacts with increasing distance from the center of the housing 53. In this way, the length of time over which each of the valves 39 remains open is increased as the speed of the engine is increased. Thus, a larger quantity of compressed gas or air is injected into the cylinders as the speed increases. Conversely, as the speed decreases and the insulating member 73 moves downwardly along the splined section 71, a minimum quantity of air is injected into the cylinder due to the shorter length of the individual radial contact 85 which is in contact with the flexible contact 83. In this way, the amount of compressed gas that is used during idling of the engine 21 is at a minimum whereas the amount of compressed gas which is required to increase the speed of the engine 21 to a level suitable to drive a vehicle on a highway is readily available.

Figure 6:
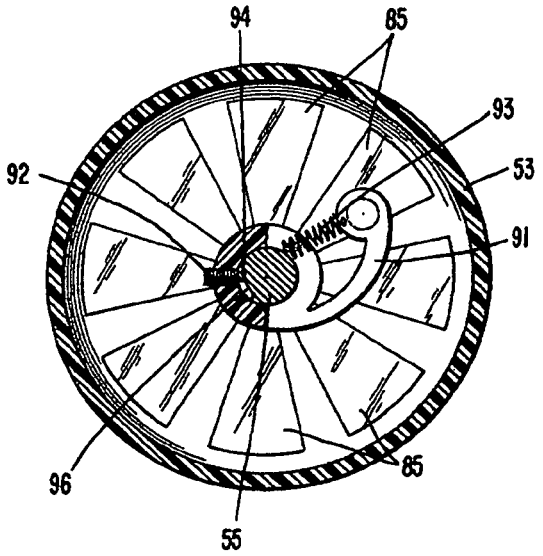
FIG. 6 is a cross-sectional view of a third embodiment of a valve actuator according to the present invention.
Figure 7:
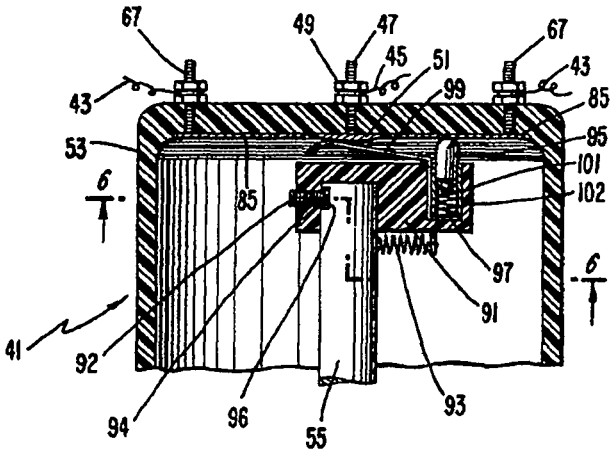
FIG. 7 is a view taken along the line 7-7 in FIG. 6.

With reference to FIGS. 6 and 7, a third embodiment of a valve actuator 41 according to the present invention includes an arcuate insulating element 91 having a first end pivotally secured by any suitable device such as screw 92 to the shaft 55 for co-rotation with the shaft 55. The screw 92 is screwed into a tapped hole in the insulating element 91 such that a tab 94 at an end of the screw 92 engages a groove 96 provided in the shaft 55. In this way, the insulating element 91 positively rotates with the shaft 55. However, as the shaft 55 rotates faster, a second end 98 of the insulating element 91 is permitted to pivot outwardly under the influence of centrifugal force because of the groove 96 provided in the shaft 55. A spring 93 connected between the second end 98 of the element 91 and the shaft 55 urges the second end of the element 91 towards the center of the housing 53.

A contact 99 similar to the contact 59 (FIG. 2) is arranged such that one end of the contact 99 is in constant contact with the conducting plate 51 located centrally within the housing 53. The other end of the contact 99 engages a conductive sleeve 101 arranged in bore 102. A contact element 95 is arranged in the conductive sleeve 101 in constant contact with the sleeve 101. The bore 102 is arranged generally parallel to the shaft 55 near the second end of the arcuate insulating element 91. The contact 95 is biased by a spring 97 towards the upper inside surface of the housing 53 for selective contact with each of the plurality of radial contacts 85 which increase in arc length towards the outer peripheral surface of the housing 53 (FIG. 6).

In operation of the device of FIGS. 6 and 7, as the shaft 55 rotates the arcuate insulating element 91 rotates with the shaft 55 and the second end 98 of the insulating element 91 tends to pivot about the shaft 55 due to centrifugal force. Thus, as the effective length of the contact 95 increases, i.e., as the arcuate insulating element 91 pivots further outwardly, the number of degrees of rotation over which the contact 95 is in contact with each of the radial contacts 85 on the upper inside surface of the housing 53 increases thereby permitting each of the valves 39 to remain open for a longer period of each engine cycle to admit more compressed gas to the respective cylinder 20 to further increase the speed of the engine 21.

With reference to FIG. 1, a mechanical advance linkage 104 which is connected to the throttle linkage 35, advances the initiation of the opening of each valve 39 such that compressed gas is injected into the respective cylinder further before the piston 22 in the respective cylinder 20 reaches a top dead center position as the speed of the engine is increased by moving the throttle linkage 35. The advance linkage 104 is similar to a conventional standard mechanical advance employed on an internal combustion engine. In other words, the linkage 104 varies the relationship between the angular positions of a point on the shaft 55 and a point on the housing 53 containing the contacts. Alternatively, a conventional vacuum advance could also be employed. By advancing the timing of the opening of the valves 39, the speed of the engine can more easily be increased.

The operation of the engine cycle according to the present invention will now be described. The compressed gas injected into each cylinder of the engine 21 drives the respective piston 22 downward to drive a conventional crankshaft (not shown). The movement of the piston downwardly causes the compressed gas to expand rapidly and cool. As the piston 22 begins to move upwardly in the cylinder 20 a suitable exhaust valve (not shown) arranged to close an exhaust passageway is opened by any suitable apparatus. The expanded gas is then expelled through the exhaust passageway. As the piston 22 again begins to move downwardly a suitable intake valve opens to admit ambient air to the cylinder. The intake valve closes and the ambient air is compressed on the subsequent upward movement of the piston until the piston reaches approximately the top dead center position at which time the compressed gas is again injected into the cylinder 20 to drive the piston 22 downward and the cycle begins anew.

In the case of adapting a conventional internal combustion engine for operation on compressed gas, a plurality of plates 103 are preferably arranged over an end of the exhaust passageways in order to reduce the outlet size of the exhaust passageways of the conventional internal combustion engine. In the illustrated embodiment, a single plate having an opening in the center is bolted to the outside exhaust passageway on each bank of the V-8 engine while another single plate having two openings therein is arranged with one opening over each of the interior exhaust passageways on each bank of the V-8 engine. A line 105 is suitably attached to each of the adaptor places to carry the exhaust to an appropriate location. In a preferred embodiment, the exhaust lines 105 are 1½" plastic tubing.

In a preferred embodiment, the exhaust lines 105 of one bank of the V-8 engine are collected in a line 107 and fed to an inlet of a compressor 109. The pressure of the exhaust gas emanating from the engine 21 according to the present invention is approximately 25 p.s.i. In this way, the compressor 109 does not have to pull the exhaust into the compressor since the gas exhausted from the engine 21 is at a positive pressure. The positive pressure of the incoming fluid increases the efficiency and reduces wear on the compressor 109. The exhaust gas is compressed in the compressor 109 and returned through a line 111 and a check valve 113 to the compressed gas storage tank 23. The check valve 113 prevents the flow of compressed gas stored in the tank 23 back towards the compressor 109.

The pulley wheel 228 which drives the compressor 109 through the is driven by a belt 135 which is driven by a pulley 137 arranged on a drive shaft 139 of the engine 21.

Figure 8:
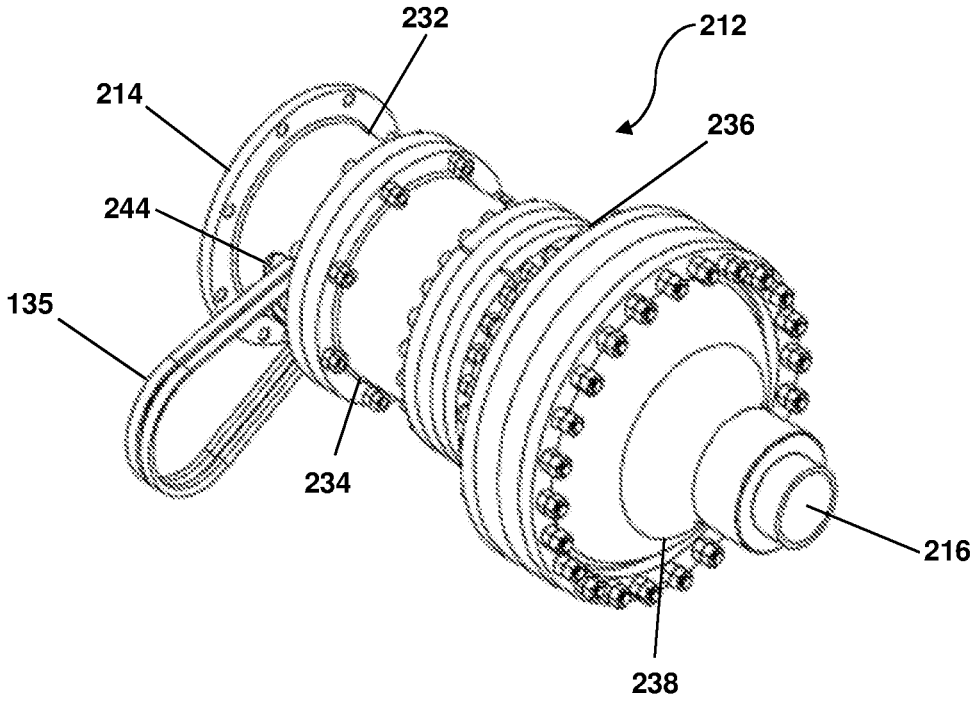
FIG. 8 is a perspective view drawing of the compressor of the present invention.
Figure 9:
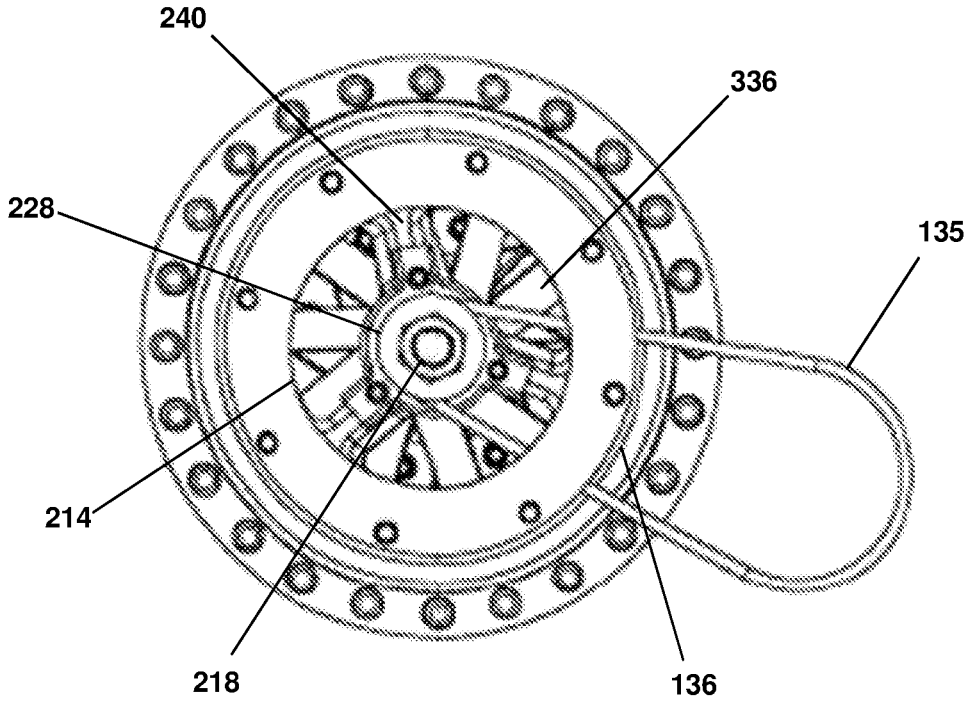
FIG. 9 is an air intake end view drawing of the compressor of the present invention.
Figure 10:
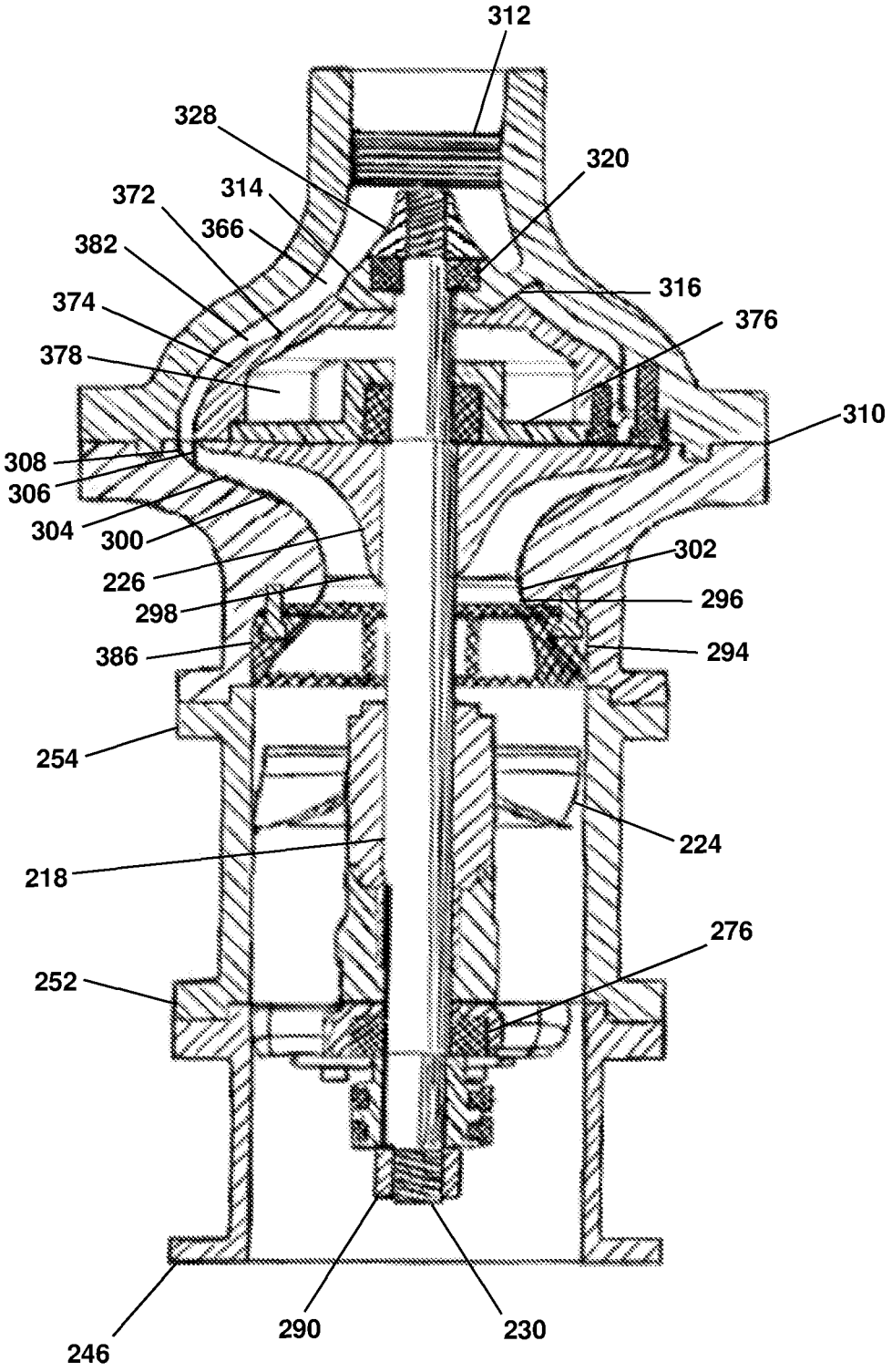
FIG. 10 is a cross-sectional view of the compressor of the present invention.

Referring to FIGS. 8, 9 and 10, a compressor 109 is provided for supplying compressed air to compressed gas storage tank 23. In accordance with a preferred embodiment of the present invention, the compressor 109 comprises a housing 212 having an axially directed inlet 214 for receiving exhaust and an axially directed outlet 216 for delivering compressed air to the compressed gas storage tank 23. Rotatably mounted within the housing 212 is a shaft 218 on which are secured an axial compressor 224 and a radial compressor 226, the radial compressor 226 being positioned downstream of the axial compressor 224. A pulley wheel 228 is secured to a forward end 230 of the shaft for receiving drive belts 135, which belts drivingly connect the shaft 218 to a pulley wheel on the crankshaft of the engine (not shown). The drive belt 135 delivers torque to the shaft 218 as required for driving the compressors 224 and 226 of the compressor 109.

The housing 212 itself is constructed from four sections which are preferably bolted together at flanged connections in end-to-end relationship. These sections include a front housing section 232, an axial compressor duct section 234, a rear housing section 236 and an exhaust cone section 238. The shaft 218 extends along the longitudinal axis of the housing 212.

The front housing section 232 is a hollow cylinder which extends forward of a front bearing support 240. The front housing section 232 encloses the forward end 230 of the shaft 218 and the associated pulley wheel 228. At its forward end, the front housing section 232 defines the inlet 214 for receiving air from an external source (not shown). Referring particularly to FIG. 2, the front housing section 232 includes a lateral opening 244 on one side in order to accommodate the connection of the drive belts 135 to the pulley wheel 228. The front housing section 232 also includes a forward flange 246 for accommodating the connection of the exhaust line 107 upstream of the compressor 109 according to the particular engine layout.

Referring again to FIG. 10, the pulley wheel 228 is interference-fitted upon the forward end 230 of shaft 218. The pulley wheel 228 is preferably a double-track design which is suitable for the attachment of twin drive belts, although a single-belt type pulley wheel would be adequate. The pulley wheel 228 is preferably sized such that the ratio of its diameter with respect to the diameter of the pulley 137 provides an effective gearing ratio in the range of approximately two. Thusly at idle, when the automobile engine is running approximately 700 rpm, the compressor 109 is running at approximately 1,400 rpm, and at cruise, when the engine is running in the range of 2,500 rpm, the compressor 109 is preferably turning over in the range of 5,000 rpm. It is to be noted that although the diameter of the pulley wheel 228 may be substantially reduced in order to achieve a desired gearing ratio, the double-track wheel 228 presents a sufficient sum total of surface area to avoid slippage of the belts 135. When the compressor is turning over at approximately 5,000 rpm, the compressor output is approximately 25 cfm at 450 psi.

The next adjacent section of housing 212 is the axial compressor duct 234 comprising a short cylinder which is coaxially disposed about the axial compressor 224. Preferably, the axial compressor duct 234 is constructed from cast aluminum, with the interior surfaces machined to assure uniform clearance between the duct 234 and the axial compressor 224. As with other sections of the housing 212, the axial compressor duct 234 is provided with flanges 252 and 254 for effecting connection to the adjacent housing sections. The axial compressor duct 234 guides air delivered from the front housing section 232 toward the axial compressor 224.

Referring now to FIG. 10, a front bearing support 240 is interposed between the front housing section 232 and the axial compressor duct 234. The front bearing support 240 is rigidly secured to the housing 212 such that loads and shocks to the shaft 218 can be transferred through the front bearing support 240 to the housing 212.

The outer raceway of the front roller bearing assembly 276 is secured by the front bearing support 240. In the preferred embodiment, the front bearing assembly 276 is of the sealed, high speed type. The front bearing assembly 276 is preferably secured to the shaft 218 with an interference fit.

The rear housing section 236 is connected by bolts to the downstream end of the axial compressor duct 234. Preferably, the rear housing section 236 is constructed from a single section of cast aluminum. The walls of the rear housing section 236 define four elements of the compressor 109: a conical transition duct 296 which favorably directs the output of the axial compressor to an inlet 298 of the radial compressor 226; a recess 294 for the deflector blade 386; the inlet 298 of the radial compressor 226, itself; and a casing 300 for the radial compressor 226.

The transition duct 296 is a hollow, frustoconical portion having a half-apex angle (from the generatrix to the axis of symmetry) of approximately 35". The angle is selected such that the inlet to the radial compressor 226 is as close as possible to the outlet of the axial compressor 224 without causing undue back-pressure. In the preferred embodiment, the transition duct 296 begins a short distance downstream of the deflector blade 386 and ends at the beginning of the inlet 298 of the radial compressor 226.

Figure 15:
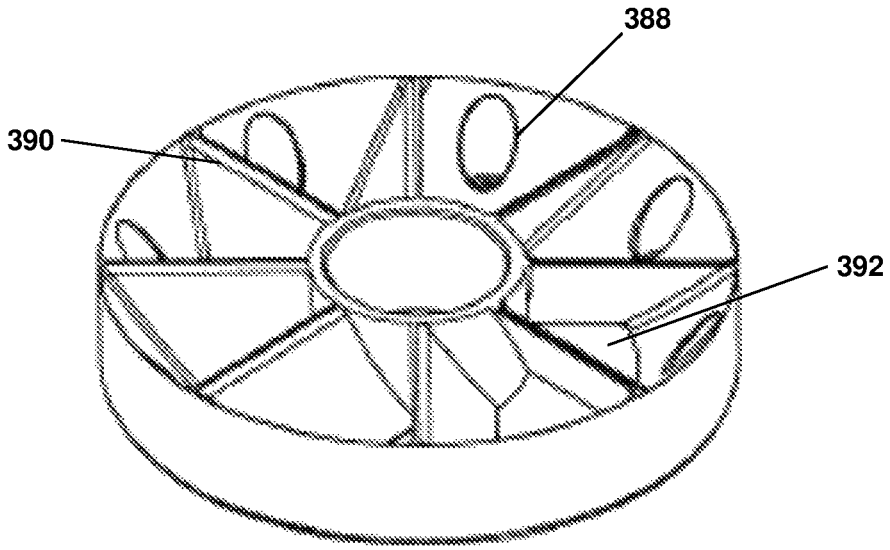
FIG. 15 is a perspective view drawing of the diverter plate component of the compressor of the present invention.
Figure 16:
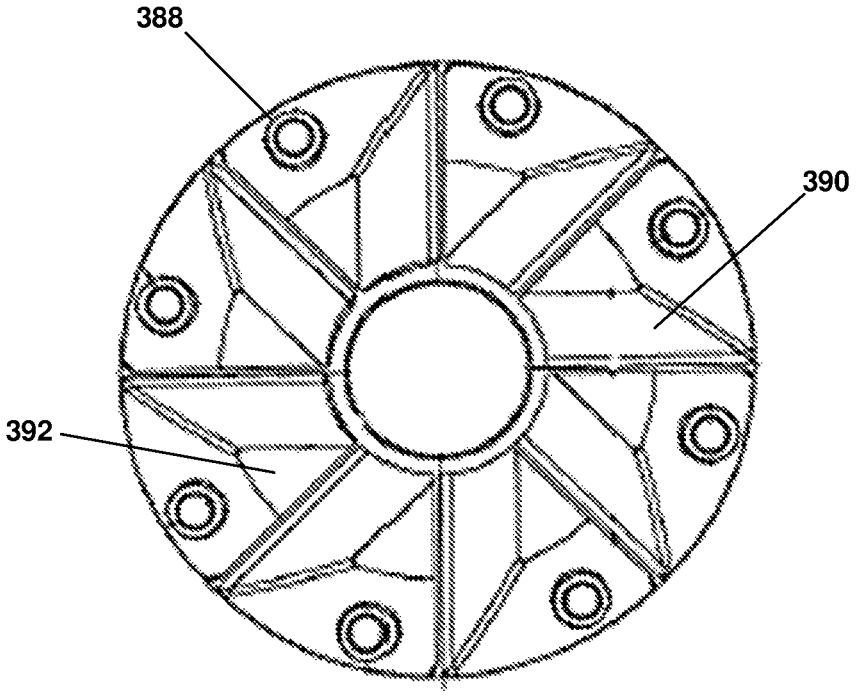
FIG. 16 is a top view drawing of the diverter plate component of the compressor of the present invention.
Figure 17:
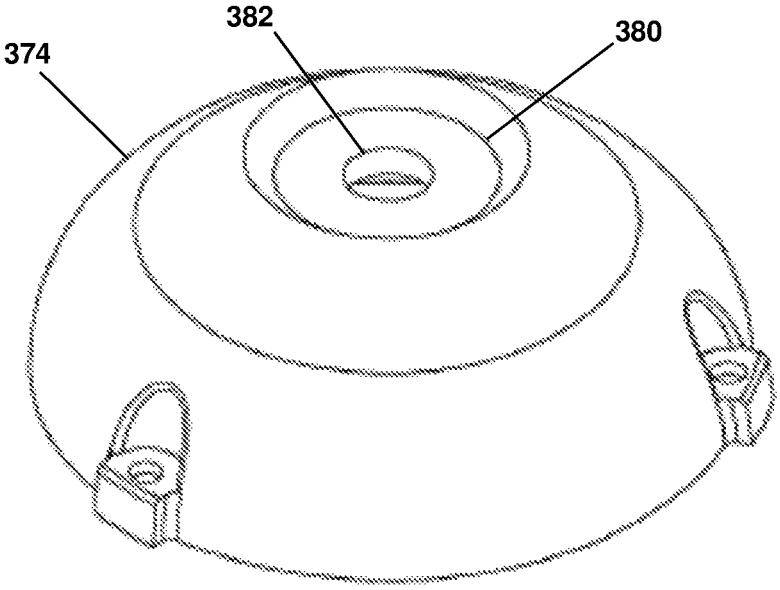
FIG. 17 is a top perspective view drawing of the upper bell housing component of the compressor of the present invention.
Figure 18:
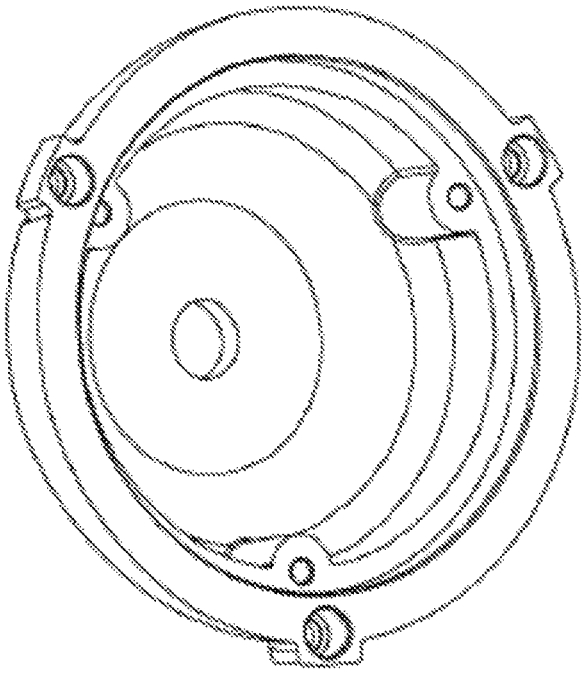
FIG. 18 is a bottom perspective view drawing of the upper bell housing component of the compressor of the present invention.
Figure 19:
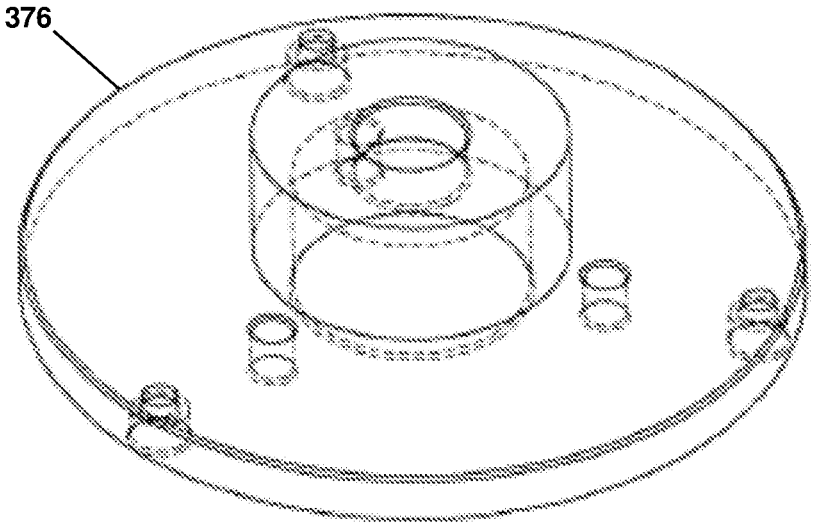
FIG. 19 is a perspective view drawing of the lower bell housing component of the compressor of the present invention.
Figure 20:
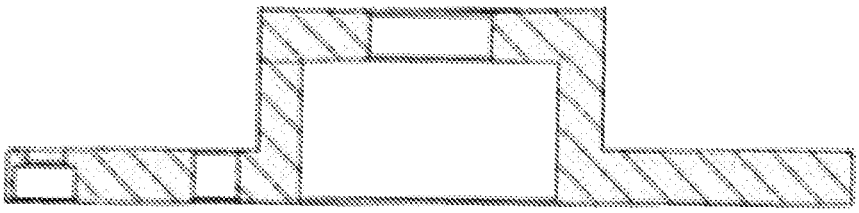
FIG. 20 is a cross sectional drawing of the lower bell housing component of the compressor of the present invention.

Referring now to FIGS. 10, 15 & 16, incorporated into the recess 294 of the transition duct 296 is a deflector blade 386. In the preferred embodiment, the deflector blade 386 is round, and the outside edge of deflector blade has a plurality of bolt holes 388, which allow the deflector blade to be bolted to the transition duct 296. The center of the deflector blade 386 comprises a plurality of angled diffuser blades 390 and veins 392. The plurality of angled diffuser blades 390 and veins 392 are angled at the opposite direction of the axial compressor blades 336. Angling the diffuser blades 390 and veins 392 at the opposite direction of the axial compressor 224 blades 336 reverses the rotational direction of the airflow as it travels through the deflector blade 386, thus, air entering the deflector blade 386 with a clock-wise rotational direction, will exit with a counter clock-wise rotational direction.

At the inlet 298 of the radial compressor 226, the walls of the rear housing 236 are cylindrical and coaxially disposed about the shaft 218. It is to be noted that in the preferred embodiment, the surface transition 302 from the transition duct 296 to the inlet 298 is rounded-off.

The casing portion 300 of the rear housing section 236 closely follows the contour defined by blade edges 304 of the radial compressor 226 in a close, substantially sealing manner as is well known in the art of radial compressors. The casing portion 300 of the rear housing section 236 channels air between the rotating blades of the radial compressor 226 so that the blades can impart work to the passing air. The casing portion 300 also defines a discharge outlet 306 for the radial compressor 226.

Just beyond the discharge outlet 306 of the radial compressor 226, the interior surfaces of the rear housing section 236 begin to curve immediately inwardly to provide a transition into the next adjacent section of the housing 212, the exhaust cone 238. In this fashion, the interior surfaces at the rear-most portion of rear housing section 236 and those of the forward portion of the exhaust cone 238 define internally a flow deflector 308. In the preferred embodiment, the flow deflector 308 is closely and concentrically disposed about the outlet 306 of the radial compressor 226 such that the air being discharged from the radial compressor 226 does not have the opportunity to diffuse significantly prior to its arrival at the annular flow deflector 308. The annular flow deflector 308 directs the output of the radial compressor 226 into the exhaust cone 238 by providing a smooth surface transition from the interior of rear housing section 236 to the interior of the exhaust cone 238.

The exhaust cone 238 is a convergent, frustoconical section placed immediately downstream of the radial compressor 226 for receiving the output of the radial compressor 226 from the annular flow deflector 308. In the preferred embodiment, the exhaust cone 238 is a single section of cast aluminum which is joined to the downstream end of the rear housing section 236 at a flanged joint 310. Preferably, the exhaust cone 238 converges according to a half-apex angle of approximately 35° and defines the exhaust port 216 at its terminus. Threading 312 at the exhaust port 216 accommodates the attachment of the appropriate external ducting (not shown) leading to the intake of the engine.

Figure 21:
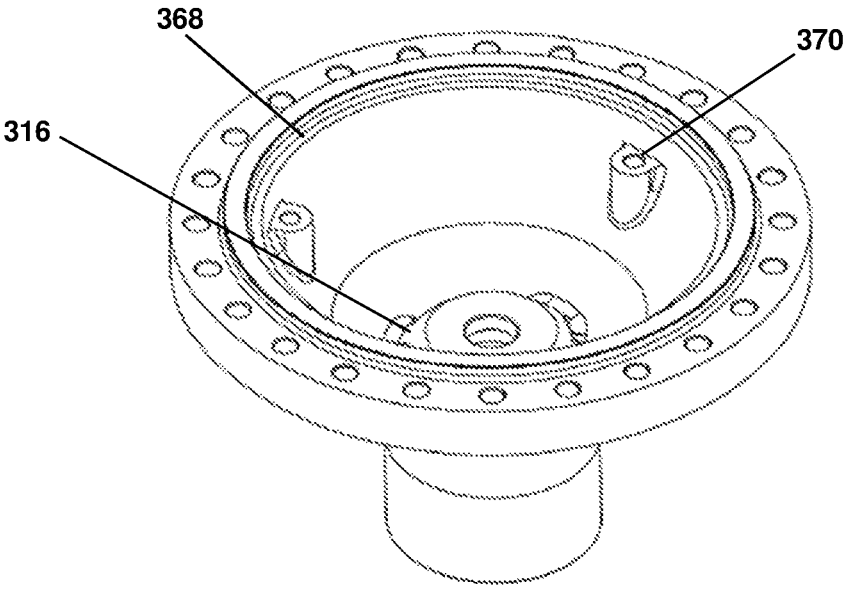
FIG. 21 is a perspective view drawing of the exhaust cone component of the compressor of the present invention.
Figure 22:
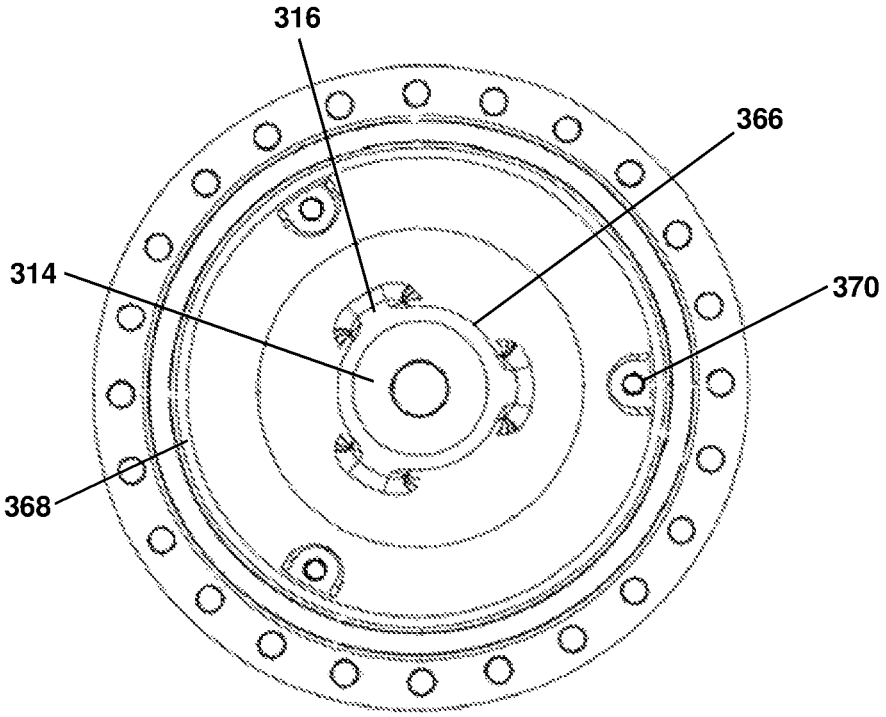
FIG. 22 is a top view drawing of the exhaust cone component of the compressor of the present invention.

Referring now to FIGS. 10, 21, and 22 the exhaust cone 238 includes a rear bearing support 314 which comprises members 316 which extend radially inwardly from the outer walls of the exhaust cone 238. At a radial inward location close to the shaft 218, the members 316 converge to form a cupped annulus which serves as a housing for the rear bearing assembly 320. In the preferred embodiment, the members 316 are integrally formed with the walls of the exhaust cone 238.

Surrounding the rear bearing support are a plurality of orifice holes 366. In the preferred embodiment, the plurality of orifice holes 366 are closely and concentrically disposed near the outlet 216 of the exhaust cone 238 such that the air being discharged from the radial compressor 226 does not have the opportunity to diffuse significantly prior to exiting the exhaust cone 238.

The exhaust cone 238 includes as step 368 located just inside of the flanged joint 310. Incorporated into the step 368 is a plurality of threaded connection points 370 located in the step 368 for connecting the bell housing 372 to the exhaust cone 238.

Referring now to FIGS. 10, 17, 18, 19, and 20, the bell housing 372 is comprised of two pieces, a upper, semi-circular section 374, and a lower section 376 which is bolted to the upper section. When the bell upper section 374 is attached to the bell lower section 376, there is a void 378, in the center of the bell housing 372. The void 378 keeps the weight of the bell housing 372, lower, to prevent the compressor 109, from getting too heavy.

The apex of the bell housing semi-circular section 374 has an contoured depression 380 in which fits against the rear bearing support 314. Additionally, the contoured depression 380 has a hole 382 in the center of the depression 380 for the shaft 218 to fit through.

Figure 11:
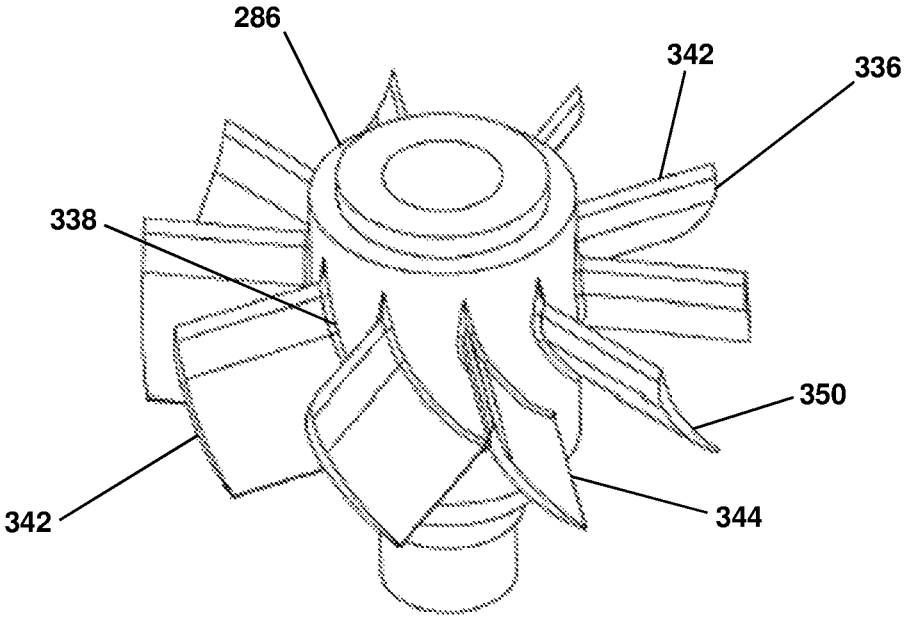
FIG. 11 is a perspective view drawing of the axial compressor component of the compressor of the present invention.
Figure 12:
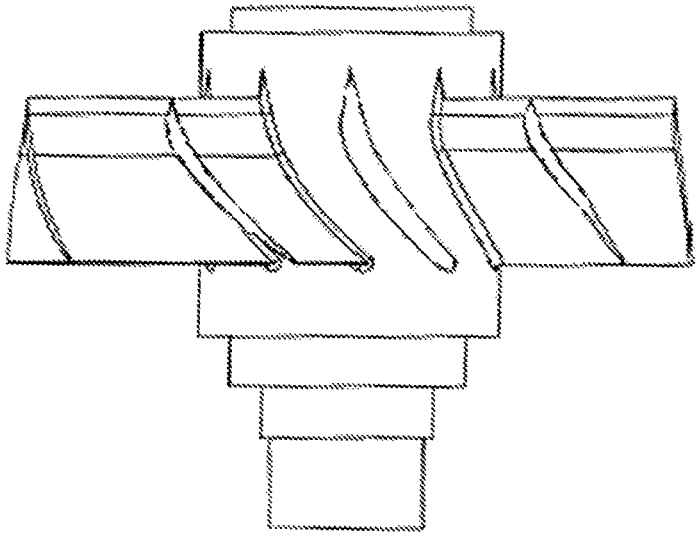
FIG. 12 is a side view drawing of the axial compressor component of the compressor of the present invention.

When the bell housing 372 is assembled and attached to the exhaust cone 238 the assembly creates a small passageway 384 between the discharge outlet 306 of the radial compressor 226 and the plurality of orifice holes 366. The incorporation of the bell housing 372 into the exhaust cone 238 prevents the air discharged from the radial compressor 226 from diffusing significantly prior to exiting the exhaust cone 238, Referring to FIGS. 10, 11, and 12, the axial compressor 224 upon rotation draws air through the inlet 214 and imparts an initial amount compression to the air as it forces the air into the transition duct 296 of the rear housing section 236. In the preferred embodiment, the axial compressor 224 comprises a hub 286 and a series of equally spaced, radially disposed blades 336. Preferably, each blade 336 increases in cord from a root 338 to a tip 340 and includes a trailing edge 342 and a leading edge 344, which edges are both slightly curved. The blades gradually increase in pitch from the root 338 to the tips 340. However, the particular values of pitch and other geometrical aspects of the blades 336 might be varied in accordance with different operating speeds or other parameters as would be apparent to one skilled in the pertinent art and familiar with this disclosure.

The axial compressor 224 is preferably constructed from a single, cast aluminum section with the faces of the hub 286 being machined for purposes of achieving accurate, axial positioning of the axial compressor 224 on the shaft 218 relative to the housing 212. Additionally, the outer periphery 350 of the axial compressor 224 is machined to assure uniform clearance between the shroud and the adjacent interior surfaces 48 of the axial compressor duct 234. The axial compressor 224 is preferably secured to the shaft 218 by an interference-fit onto the shaft 218.

Dynamic balance test machines of the conventional type may be used to test the balance of the axial compressor 224 prior to its installation. If an imbalance is detected, material can be removed at the outer periphery 350 of the axial compressor 224 so as to achieve proper balance.

Figure 13:
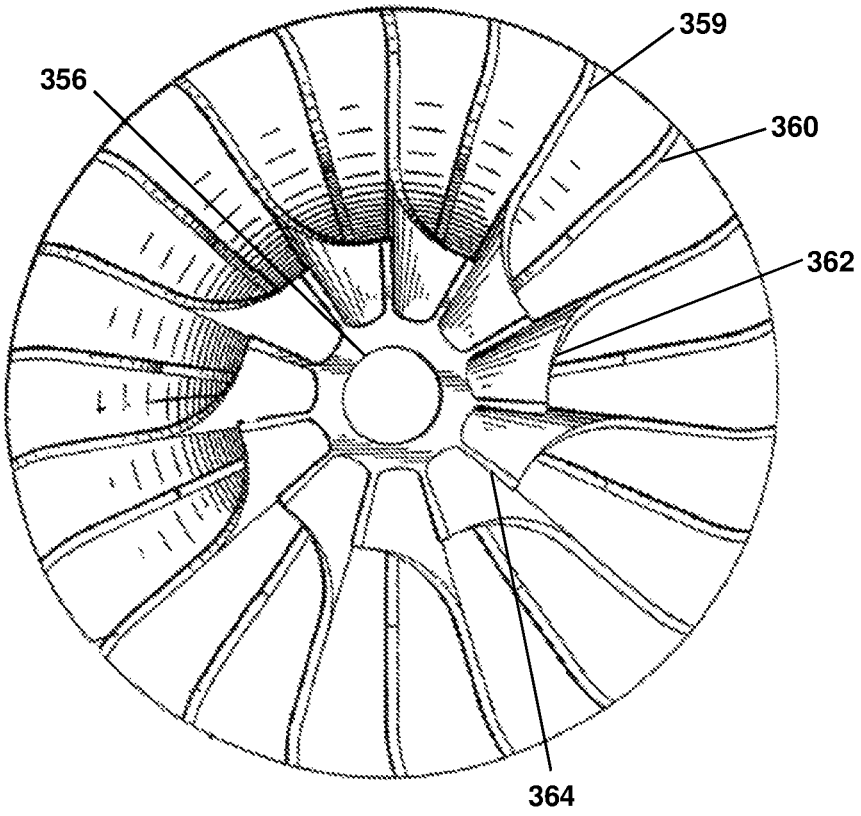
FIG. 13 is a top view drawing of the radial compressor component of the compressor of the present invention.
Figure 14:
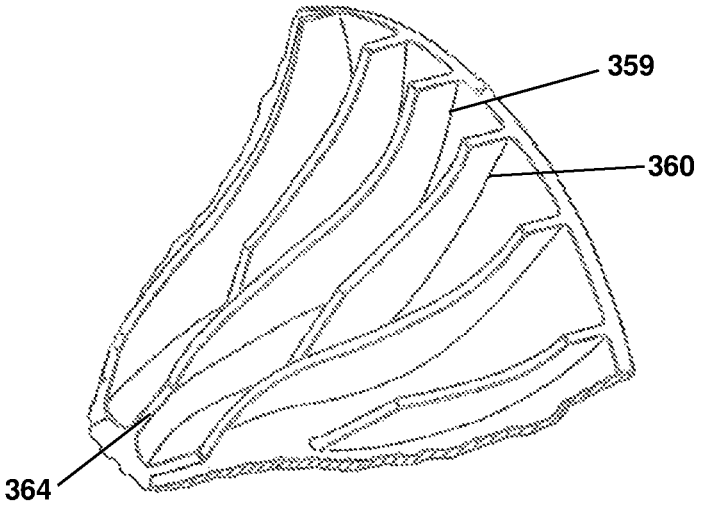
FIG. 14 is a partial sectional view drawing of the radial compressor component of the compressor of the present invention.

Referring now to FIGS. 10, 13, and 14, the radial compressor 226 is constructed from a single section of cast aluminum and includes a hub 356 and curved blades 358. Interposed between each pair of blades 358 are a second set of blades 360 which terminate short of the intake 362 of the radial compressor 226 so that the intake 362 is not crowded by both sets of blades. Accordingly, the radial compressor 226 features both a large total number of blades and an intake of relatively small diameter, which features enhance the performance of the compressor 226. In the region of the intake 362, the blades 358 present leading edges 364 and undergo a twist into the direction of rotation so as to prevent a favorable angle of attack at the intake 362.

The shaft 218 is constructed from a hardened steel and is threaded at both ends 230 and 332 for receiving nuts 290 and 328, respectively.

In operation with the compressed gas engine of the current invention, the compressor 109 is suitably connected at its outlet 216 to the line 111 and a check valve 113 to the compressed gas storage tank 23, with the drive belts 135 from the engine being attached to the pulley wheel 228. Then, as the engine is operated, torque is transferred by the drive belts 135 to the pulley wheel 228 for driving the compressors 224 and 226. Upon rotation, the axial compressor 224 draws air from the line 107 through the inlet 214, imparts an initial amount of compression to the air and discharges it into the transition duct 296 with a swirl. If the air supplied by the line 107, is insufficient, additional make up air can be drawn into the compressor 109, through the pulley opening 136.

As the discharged from the axial compressor 224 is caused to leave the axial compressor duct 234, the deflector blade 386 in the transition duct 296 is causes the air discharged from the axial compressor 224 to swirl in the opposite direction. Then action of reversing direction of the swirl of the air has the positive effect of making the radial compressor 226 more efficient. Since the axial compressor 224 and the radial compressor 226 rotate about the same shaft 218, without any turbulence in the flow, the air velocities with get excessively high when the compressor 109 is run at high rotational speeds, causing the compressor 109 to stonewall, or choke. Running the air between the axial compressor 224 and the radial compressor 226 through the deflector blade 386 prevents the air velocity from exceeding the stonewall point, maximizing the volume of air passing through the compressor 109.

Upon leaving the transition duct 296, the air enters the inlet 298 of the radial compressor 362 and then into the compressor 226 itself. In passing through the radial compressor 226, the air is turned and whirled such that the airflow is centrifugally discharged with a substantial radial velocity component, whereupon the resultant flow is abruptly turned by the annular flow deflector 308 and caused to enter the exhaust cone 238. Compressed air travels through the exhaust cone 238 through the passageway 384 created by the bell housing 372, the plurality of orifice holes 366, and exits through the outlet 216. The small cross-sectional areas of the passageway 384 and orifice holes 366 prevent the air from expanding as it exists the annular flow deflector 308, keeping the air compressed at the high pressures necessary to operate the engine. When the compressor is turning over at approximately 5,000 rpm, the compressor output is approximately 25 cfm at 450 psi.

The other bank of the V-8 engine has its exhaust ports arranged with adapter plates 103 similar to those on the first bank. However, the exhaust from this bank of the engine 21 is not collected and circulated through the compressor 109. In a preferred embodiment, a portion of the exhaust is collected in a line 159 and fed to an enlarged chamber 161. A second fluid is fed through a line 163 into the chamber 161 to be cooled by the cool exhaust emanating from the engine 21 in the line 159. The second fluid in the line 163 may be either transmission fluid contained in a transmission associated with the engine 21 or a portion of the oil used to lubricate the engine 21. A second portion of the exhaust from the second bank of the V-8 engine is removed from the line 159 in a line 165 and used as a working fluid in an air conditioning system or for any other suitable use.

It should be noted that the particular arrangement utilized for collecting and distributing the gas exhausted from the engine 21 would be determined by the use for which the engine is employed. In other words, it may be advantageous to rearrange the exhaust tubing such that a larger or smaller percentage of the exhaust is routed through the compressor 109. It should also be noted that since the exhaust lines 105 are plastic tubing, a rearrangement of the lines for a different purpose is both simple and inexpensive.

In operation of the engine of the present invention, the engine 21 is started by energizing the solenoid valve 29 and any suitable starting device (not shown), e.g., a conventional electric starter as used on an internal combustion engine. Compressed gas from the full tank 23 flows through the line 25 and a variable amount of the compressed gas is admitted to the distributor 33 by controlling the regulator valve 31 through the linkage 34 and the operator actuated throttle linkage 35. The compressed gas is distributed to each of the lines 37 which lead to the individual cylinders 20. The compressed gas is admitted to each of the cylinders 20 in timed relationship to the position of the pistons within the cylinders by opening the valves 39 with the valve actuator 41.

When it is desired to increase the speed of the engine, the operator moves the throttle linkage 35 which simultaneously admits a larger quantity of compressed gas to the distributor 33 from the tank 23 by further opening the regulator valve 31. The timing of the valve actuator 41 is also advanced through the linkage 104. Still further, as the speed of the engine 21 increases, the effective length of the rotating contact 83 (FIG. 4) or 95 (FIG. 6) increases thereby electrically contacting a wider portion of one of the stationary radial contacts 85 to cause each of the valves 39 to remain open for a longer period of each engine cycle to admit a larger quantity of compressed gas to each of the cylinders 20.

As can be seen, the combination of the regulating valve 31, the mechanical advance 104, and the valve actuator 41, combine to produce a compressed gas engine which is quickly and efficiently adaptable to various operating speeds. However, all three of the controls need not be employed simultaneously. For example, the mechanical advance 104 could be utilized without the benefit of one of the varying valve actuators 41 but the high speed operation of the engine may not be as efficient. By increasing the duration of each engine cycle over which each of the valves 39 remains open to admit compressed gas to each of the cylinders 20 as the speed increases, conservation of compressed gas during low speed operation and efficient high speed operation are both possible.

After the compressed gas admitted to the cylinder 20 has forced the piston 22 downwardly within the cylinder to drive the shaft 139 of the engine, the piston 22 moves upwardly within the cylinder 20 and forces the expanded gas out through a suitable exhaust valve (not shown) through the adapter plate 103 (if employed) and into the exhaust line 105. The cool exhaust can then be collected in any suitable arrangement to be compressed and returned to the tank 23 or used for any desired purpose including use as a working fluid in an air conditioning system or as a coolant for oil.

When using the apparatus and method of the present invention to adapt a ordinary internal combustion engine for operation with compressed gas it can be seen that considerable savings in weight are achieved. For example, the ordinary cooling system including a radiator, fan, hoses, etc. can be eliminated since the compressed gas is cooled as it expands in the cylinder. In addition, there are no explosions within the cylinder to generate heat. Further reductions in weight are obtained by employing plastic tubing for the lines which carry the compressed gas between the distributor and the cylinders and for the exhaust lines. Once again, heavy tubing is not required since there is little or no heat generated by the engine of the present invention. In addition, the noise generated by an engine according to the present invention is considerably less than that generated by an ordinary internal combustion engine since there are no explosions taking place within the cylinders.

The principles of preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the invention. Accordingly, it is expressly intended that all such variations and changes which fall within the spirit and the scope of the present invention as defined in the appended claims be embraced thereby.

What is claimed is:

1. An apparatus for operating an engine having at least one cylinder and a reciprocating piston therein comprising:

a compressor that supplies compressed gas to the engine said compressor comprising an axial compressor comprising angled axial compressor blades upstream of a radial compressor, a compressor pulley, a shaft connecting the axial compressor, the radial compressor and the pulley, a housing enclosing the axial compressor, the radial compressor, the pulley, and the shaft, said housing having an inlet section, and pulley opening, and a hollow, cone shaped exhaust section with an insert inside the exhaust cone creating a passageway between the insert and the exhaust cone preventing compressed gas exiting the radial compressor from expanding before the compressed gas exits the compressor;

distributor means connected with the compressor for distributing the compressed gas to the at least one cylinder;

valve means for admitting the compressed gas to the at least one cylinder when the piston is in approximately a top dead center position within the cylinder;

varying means for increasing the duration of each engine cycle over which the valve means admits compressed gas to the at least one cylinder as the speed of the engine increases;

exhaust means for exhausting gas as the piston subsequently approaches approximately the top dead center position;

a rotating engine output shaft driven by the engine with an engine pulley at one end; and a belt connecting the compressor pulley and the engine pulley through said pulley opening, where rotation of the engine output shaft drives rotation of the axial and radial compressors.

2. The apparatus of claim 1, said compressor further comprising a stationary deflector blade comprising a plurality of angled diffuser blades and veins, said diffuser blades angled in the opposite direction of said axial compressor blades and said deflector blade located downstream of axial compressor and upstream of the radial compressor.

3. The apparatus of claim 1, further comprising at least one line connecting said exhaust means for exhausting gas and said compressor inlet whereby supply gas for the compressor is primarily provided from said exhaust means and makeup gas is provided through the pulley opening.

4. An apparatus for operating an engine having at least one cylinder and a reciprocating piston therein comprising:

a compressor that supplies compressed gas to the engine said compressor comprising an axial compressor comprising angled axial compressor blades upstream of a radial compressor, a stationary deflector blade comprising a plurality of angled diffuser blades and veins said diffuser blades angled in the opposite direction of said axial compressor blades and said deflector blade located downstream of axial compressor and upstream of the radial compressor a compressor pulley, a shaft connecting the axial compressor, the radial compressor and the pulley, a housing enclosing the axial compressor, the radial compressor, the pulley, and the shaft, said housing having an inlet section, an exhaust section, and a pulley opening;

distributor means connected with the compressor for distributing the compressed gas to the at least one cylinder;

valve means for admitting the compressed gas to the at least one cylinder when the piston is in approximately a top dead center position within the cylinder;

varying means for increasing the duration of each engine cycle over which the valve means admits compressed gas to the at least one cylinder as the speed of the engine increases;

exhaust means for exhausting gas as the piston subsequently approaches approximately the top dead center position;

a rotating engine output shaft driven by the engine with an engine pulley at one end; and a belt connecting the compressor pulley and the engine pulley through said pulley opening, where rotation of the engine output shaft drives rotation of the axial and radial compressors.

5. The apparatus of claim 4, said compressor exhaust section further comprising a hollow conical shape with an insert inside the exhaust section creating a passageway between the insert and the exhaust cone preventing compressed gas exiting the radial compressor from expanding before the compressed gas exits the compressor.

6. The apparatus of claim 4, further comprising at least one line connecting said exhaust means for exhausting gas and said compressor inlet whereby supply gas for the compressor is primarily provided from said exhaust means and makeup gas is provided through the pulley opening.

7. The apparatus of claim 5, further comprising at least one line connecting said exhaust means for exhausting gas and said compressor inlet whereby supply gas for the compressor is primarily provided from said exhaust means and makeup gas is provided through the pulley opening.

* * * * *